United States Patent [19]

Teppa

[11] Patent Number: 4,469,006

[45] Date of Patent: Sep. 4, 1984

[54] AUTOMATIC FIRE-ARM

[75] Inventor: Roberto Teppa, Turin, Italy

[73] Assignee: Sites S.p.A., Mondovi, Italy

[21] Appl. No.: 339,224

[22] Filed: Jan. 13, 1982

[30] Foreign Application Priority Data

May 12, 1981 [IT] Italy ..... 67641 A/81

[51] Int. Cl.[3] ..... F41D 11/02

[52] U.S. Cl. ..... 89/149

[58] Field of Search ..... 42/69 A; 89/131, 149

[56] References Cited

U.S. PATENT DOCUMENTS

| | | | |
|---|---|---|---|
| 1,190,653 | 7/1916 | Hughes | 89/149 |
| 1,425,627 | 8/1922 | Bardelli | 89/149 |
| 3,236,154 | 2/1966 | Iwashita | 89/131 |

FOREIGN PATENT DOCUMENTS

| | | | |
|---|---|---|---|
| 229592 | 2/1925 | United Kingdom | 89/149 |

OTHER PUBLICATIONS

Smith et al., The Book of Rifles, 1948, p. 591.

*Primary Examiner*—Stephen C. Bentley

*Attorney, Agent, or Firm*—Sughrue, Mion, Zinn, Macpeak & Seas

[57] ABSTRACT

The automatic fire arm is provided with a bolt and hammer which reciprocate along the axis of the barrel. A first spring normally biases the bolt against the breech end of the barrel and a second spring normally biases the hammer against a firing which is slidably mounted within the bolt. A moveable retaining lever is pivotally mounted below the chamber in which the bolt and hammer are located. An upwardly extending projection is provided on each end of the lever which is extendable into the chamber through axially spaced apertures. A trigger mounted pin normally holds the lever with the rearmost projection extending into the chamber so that upon retraction of the bolt and hammer the hammer will be held in cocked position by the rearmost projection when the bolt returns to engage the breech end of the barrel. When the trigger is operated, the forwardmost projection on the lever will be free to move upwardly into the chamber only when the bolt contacts the breech end of the barrel, thereby allowing the hammer to force the rearmost projection downwardly out of the chamber so that the hammer can contact the firing pin.

3 Claims, 5 Drawing Figures

AUTOMATIC FIRE-ARM

The present invention relates to an automatic firearm of the type including a frame supporting a casing to which a barrel is fixed, a chamber formed in the casing adjacent the breech of the barrel and in which a bolt carrying a firing pin is movably mounted, the bolt being movable through the effect of the pressure of gases produced during firing from a forward or closing position, in which it closes the breech, to a withdrawn or open position against the action of first resilient means biassing it into the closing position, a hammer block mounted in the chamber and movable between a first withdrawn or arming position and a forward or striking position in which it is able to act on the firing pin, second resilient means which bias the hammer block from the withdrawn position to the forward striking position, and a trigger or firing mechanism which is actuated by a firing lever or trigger and is operable to allow the movement of the hammer block from the arming position to the striking position.

Automatic fire-arms of the type specified above allow bursts of shots to be fired with a very high rate of fire.

As is known, control of the fire-arm becomes uncertain when firing bursts of shots, that is to say, it is very difficult to keep the weapon pointed at the target since it tends to "climb". This results in less accurate firing and considerable wastage, since the number of poorly-aimed shots fired is anything other than negligible.

It has been attempted to avoid this disadvantage by making heavier fire-arms which thus have a greater inertia, thereby reducing the "climbing" of the weapon during firing.

This solution is unsatisfactory, however, since the greater weight of the fire-arm makes it less manageable and also costlier to manufacture.

The object of the present invention is to provide an automatic fire-arm which is free from the disadvantages present in fire-arms made according to the prior art, and which is therefore light, easy to handle, and able to fire bursts of shots with high accuracy and stability.

In order to achieve this object, the present invention provides an automatic fire-arm of the aforesaid type, the main characteristic of which lies in the fact that it includes:

a movable retaining member which is supported by the frame and extends into the chamber, the retaining member being able to adopt a rest position in which it allows the joint movement of the bolt and the hammer block from their respective forward positions to their respective withdrawn positions, and a working position in which it retains the hammer block substantially in its withdrawn position when the bolt is moved from its withdrawn position towards its forward closing position, the retaining member being movable from the rest position to the working position through the movement of the bolt from the forward closing position to the withdrawn position, and being movable from the working position to the rest position only when the bolt is in the last part of its closing movement, and a control member which is controlled by the firing lever or trigger and, cooperating with the retaining member, is able to adopt a rest position in which it holds the retaining member in its working position when the trigger is released, and a working position in which it allows the movement of the retaining member from the working position to the rest position and back, when the trigger is pulled.

In the fire-arm according to the present invention, a delay time is introduced between the moment when the bolt reaches the closing position and the moment when the hammer block reaches the striking position. In other words, the fire-arm according to the invention achieves a three-stage cycle (joint withdrawal of the bolt and hammer block, advancement of the bolt alone, and advancement of the hammer block) instead of the two-stage cycle which occurs in conventional automatic fire-arms. This allows bursts of shots to be fired with a lower firing rate, greater stability and accuracy, and less wastage of ammunition.

Further characteristics and advantages of the firearm according to the present invention will become apparent from the detailed description which follows with reference to the appended drawings, provided purely by way of non-limiting example, in which.

Figure 1:
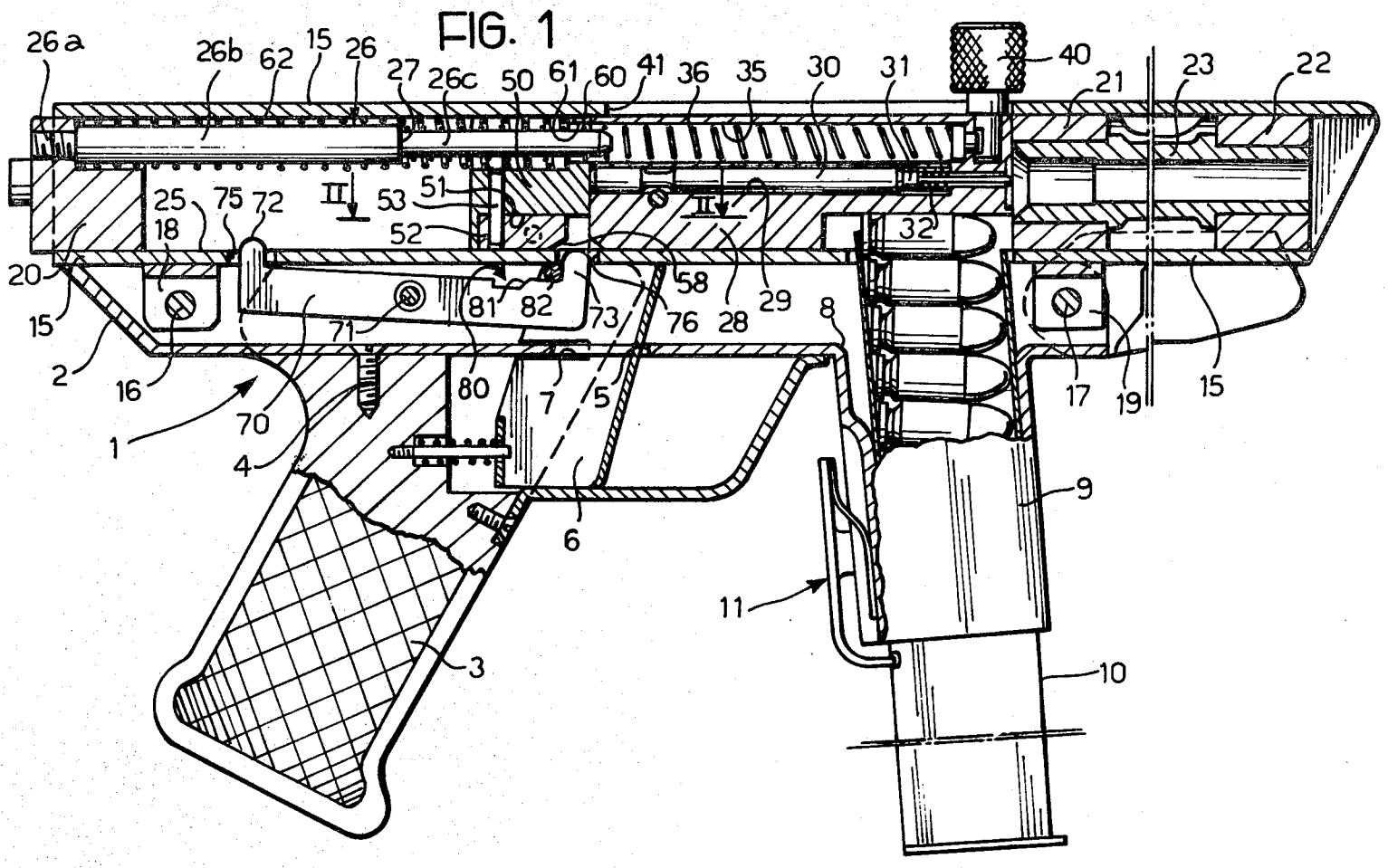
FIG. 1 is a partially-sectioned side view of an automatic fire-arm according to the invention.

With reference to FIG. 1, an automatic fire-arm according to the invention comprises a frame or support structure, generally indicated 1, comprising a shaped body 2 to which a grip 3 is fixed by means of screws 4. The body 2 is shaped substantially in the form of a tray and its wall has a longitudinal slot 5 close to the grip 3, in which a firing lever or trigger 6 is movably mounted. In FIG. 1, the trigger 6 is shown in the position which it adopts when it is released. This trigger has a notch 7 in its central portion which, when the trigger is pulled, is engageable with the portion of the bottom wall of the body 2 adjacent the slot 5.

The wall of the shaped body 2 also has an aperture 8 connected to one end of a tubular element 9 which acts as a guide for a clip or magazine 10 of ammunition. This magazine is of the conventional spring type. The tubular element 9 is provided with a conventional positioning device, generally indicated 11, for maintaining the magazine 10 in a fixed position relative to the tubular element 9.

A tubular part 15 is fixed to the shaped body 2 by a pair of pins 16, 17 which extend through the holes of respective lugs 18, 19 fixed to the outer surface of the tubular part 15, and corresponding holes in the side walls of the shaped body 2. The tubular part 15 is closed at one end by an end-piece 20.

Two centering sleeves 21, 22 are fixed in the tubular part 15, which locate respectively the breech and muzzle ends of the barrel 23.

Within the tubular part or casing 15, between the end-piece 20 and the breech of the barrel 23, is a chamber 25.

By 26 is indicated a rod which extends longitudinally within the chamber 25. The rod 26 has a tang **26*a* fixed to the end-piece 20, a central portion 26*b*, and an end portion 26*c* which faces a barrel 23 and has a reduced diameter so as to define an annular shoulder 27 with the central portion 26*b***.

A bolt 28 is movably mounted in the chamber 25. The bolt 28 has an internal axial through-hole 29 in which a conventional type of striker mechanism including a thrust member 30 and a firing pin 31, is movably housed. In the part facing the barrel 23, the hole 29 has a reduced diameter portion through which the shaft of the firing pin 31 extends against the action of a spring 32.

The bolt 28 also has an axial hole 35 which opens towards the rod 26. The hole 35 is aligned axially with this rod, and has a larger diameter than the central portion **26*b* of the rod. A helical spring 36 is located in the hole 35 of the bolt surrounding the portion 26*c* of the rod 26. This spring acts at one end against the annular shoulder 27 of the rod 26 and at the other end against the end wall of the hole 35** in the bolt.

A cocking handle 40 is fixed to the upper part of the bolt 28, and extends through an axial slot 41 in the upper wall of the tubular part 15.

A hammer block 50 is disposed in the chamber 25 of the tubular part 15. The hammer block 50 has a recess 51 in its lower face. A sear 52 is rotatably mounted in the recess 51 of the hammer block about a pin 53 which is carried by this block and extends perpendicular to the longitudinal axis of the tubular part 15.

Figures 2, 3:
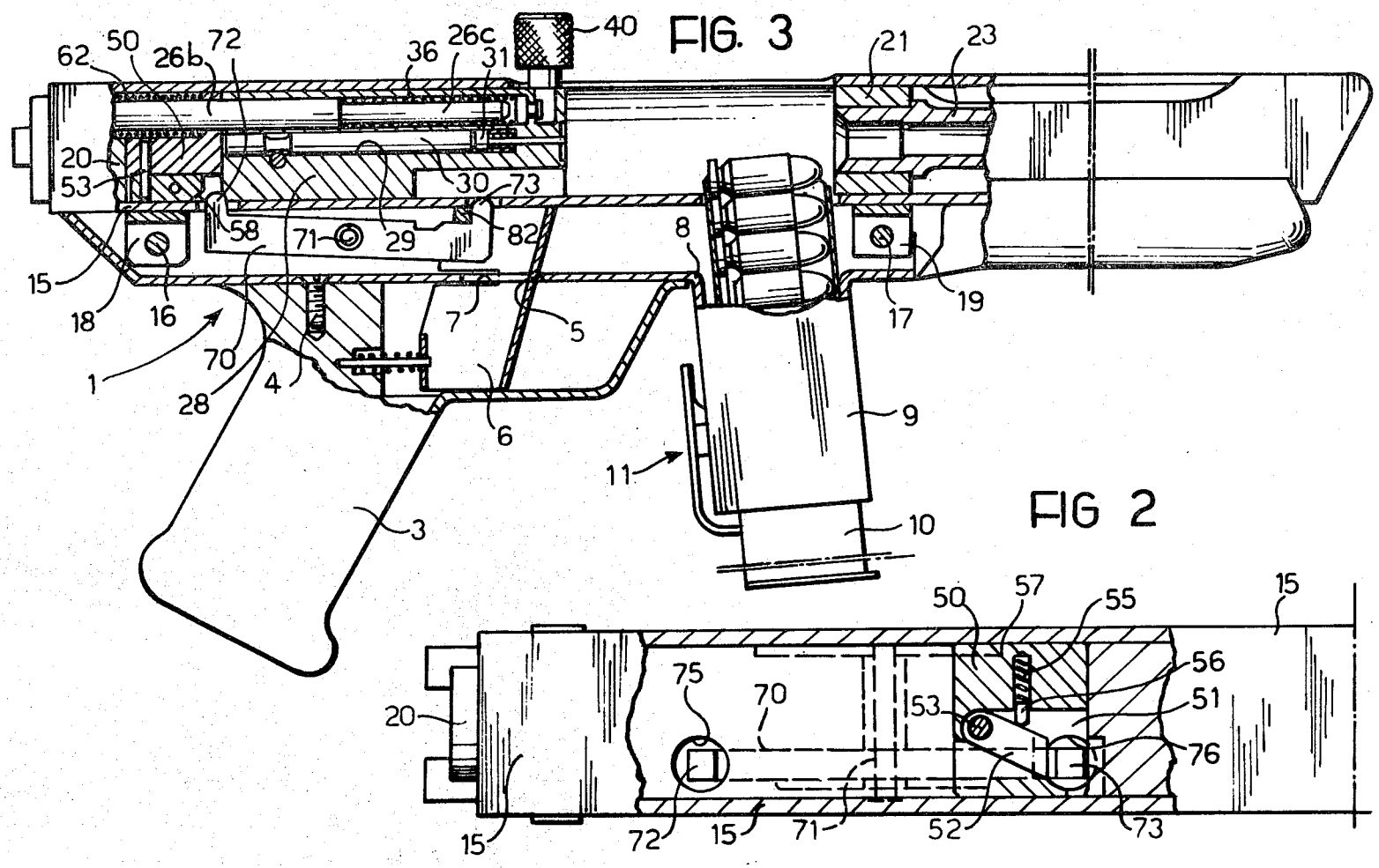
FIG. 2 is a partial section taken on the line II—II of FIG. 1.
FIGS. 3, 4 and 5 are partially-sectioned side views of the fire-arm of FIG. 1, in three different stages of operation.

As shown in FIG. 2, the hammer block 50 has a hole 55 extending perpendicular to the axis of the pin 53, which is formed in a wall of the recess 51 in a position facing the sear 52. In this hole 55 are disposed a thrust member 56 and a spring 57 which biasses the thrust member resiliently against the sear 52.

As shown in FIG. 1, the end of the sear 52 facing the bolt 28 has a bevel which defines an inclined surface 58.

At the top, the hammer block 50 has an appendage 60 which extends transverse the longitudinal axis of the tubular part 15 and has a guide hole 61 coaxial with the rod 26. The diameter of the guide hole 61 is greater than the diameter of the central portion **26*b*** of this rod.

A helical spring 62 is disposed around the rod 26 and the spring 36, this spring 62 acting at one end against the appendage 60 of the hammer block 50. Preferably, the springs 36, 62 are wound in opposite directions.

A rocker lever 70 is supported by the shaped body 2 below the tubular part 15 and is pivoted about a pin 71 extending perpendicular to the longitudinal axis of the tubular part 15. The ends of the lever 70 have respective projections or teeth 72, 73 which face upwardly and extend through respective apertures 75, 76 in the wall of the tubular element 15 facing the shaped body 2. The teeth 72, 73 have rounded profiles.

As will be described below, the lever 70 is able to adopt a first position, termed the working or retaining position, in which the tooth 72 extends through the aperture 75 of the tubular part 15 and projects into the chamber 25 of this tubular part. The lever 70 is also able to adopt a second position, termed the rest position, in which the tooth 73 extends through the aperture 76 in the tubular part 15 and projects into the chamber 25. The upper surface of the lever 70 facing the tubular part 15 has a notch 80 in the part between the pin 71 and the tooth 73. This notch has an inclined surface 81 which connects the bottom surface of the notch to the portion of the upper surface of the lever 70 adjacent the tooth 73.

A pin 82 is fixed to the upper part of the trigger 6 and extends parallel to the pivot pin 71 of the lever 70. When the trigger is in its released position (FIG. 1), the pin 82 engages that portion of the upper surface of the lever 70 between the notch 80 and the tooth 73, maintaining the lever in the working position defined above, as shown in FIG. 1.

The operation of the automatic fire-arm according to the invention will now be described with reference to FIGS. 1, 3, 4 and 5.

It is assumed that the fire-arm is initially in its rest condition shown in FIG. 1, wherein the bolt 28 is in its forward or closing position, the hammer block is in its forward or striking position in contact with the bolt, and the return springs 36, 62 are relaxed.

Manual operation of the cocking handle 40 causes movement of the bolt 28 and hammer block from their forward positions to their withdrawn or arming positions shown in FIG. 3. As a result of this operation, the bolt 28 compresses the spring 36, while the hammer block 50 compresses the spring 62 which, as will be clarified below, provides the energy for firing. In the course of the movement, the bolt slides over the front tooth 73 of the rocker lever 70 which is maintained in the position shown in FIG. 1 by the pin 82 carried by the trigger 6, and, after the initial part of the movement, the sear 52 of the hammer block 50 encounters the rear retaining tooth 72 of the rocker lever 70, which projects into the chamber 25. The sear 52 is thus made to rotate about the pin 53 to allow the further withdrawal of the hammer block 50. During this rotation, the sear 52 compresses the spring 57, through the thrust member 56. As soon as the front end of the sear 52 has passed over the retaining tooth 72, the sear is returned to its initial position by the thrust imparted through the thrust member 56 under the action of the spring 57. In this position, the sear 52 is ready to bear against the rear retaining tooth 72 of the rocker lever 70.

Figure 4:
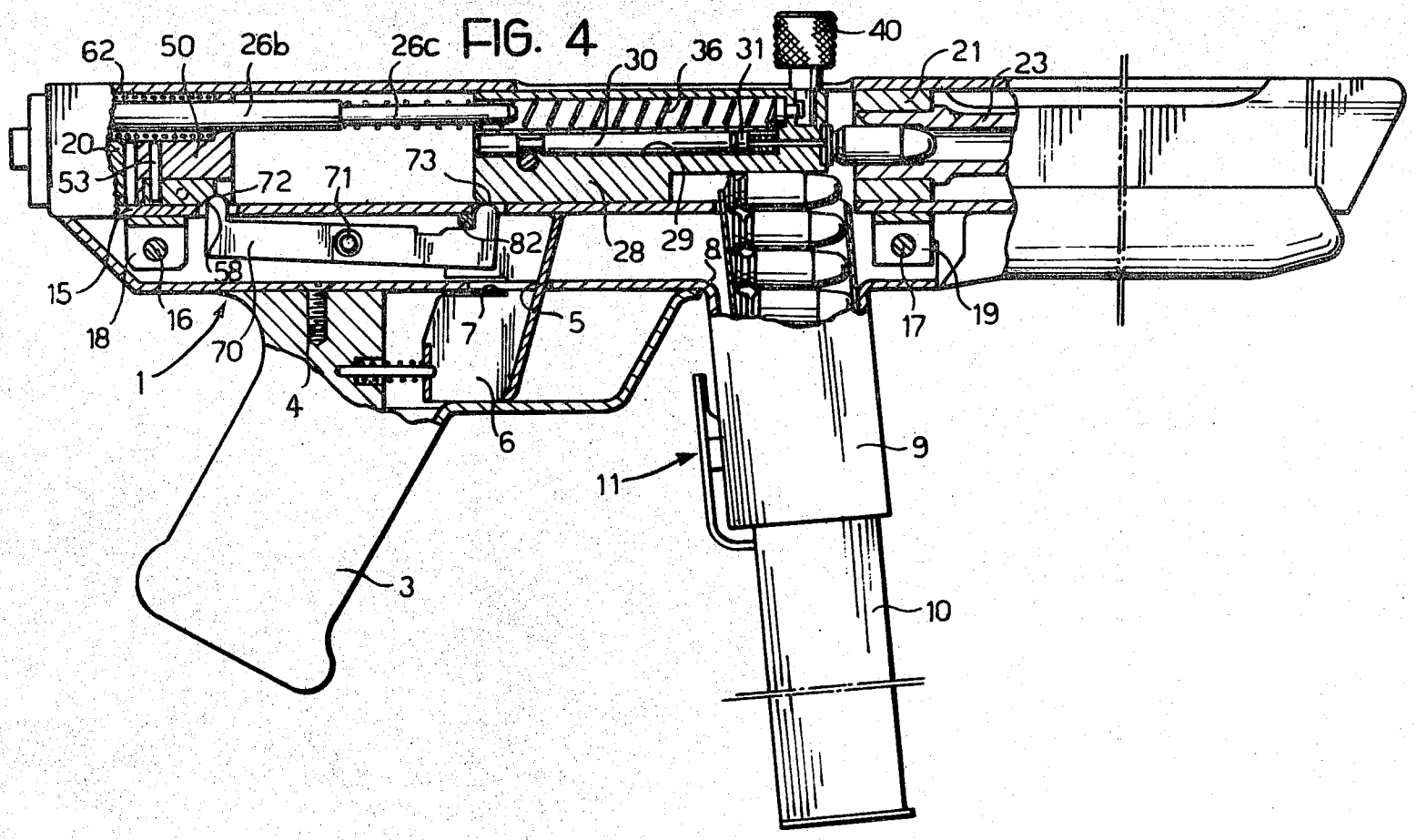

When the cocking handle 40 is released, the bolt 28 is returned to its closing position by the extension of the return spring 36. During this return movement the bolt 28 strips a cartridge from the clip or magazine 10 by means of a shaped heel, and thrusts it into the barrel 23 (FIG. 4). The hammer block 50 is urged by its return spring 62 and tends to advance, but after moving a very short distance is retained in a withdrawn position by the engagement of the sear 52 with the rear retaining tooth 72 of the rocker lever 70.

In this condition, the fire-arm is ready for firing.

Figure 5:
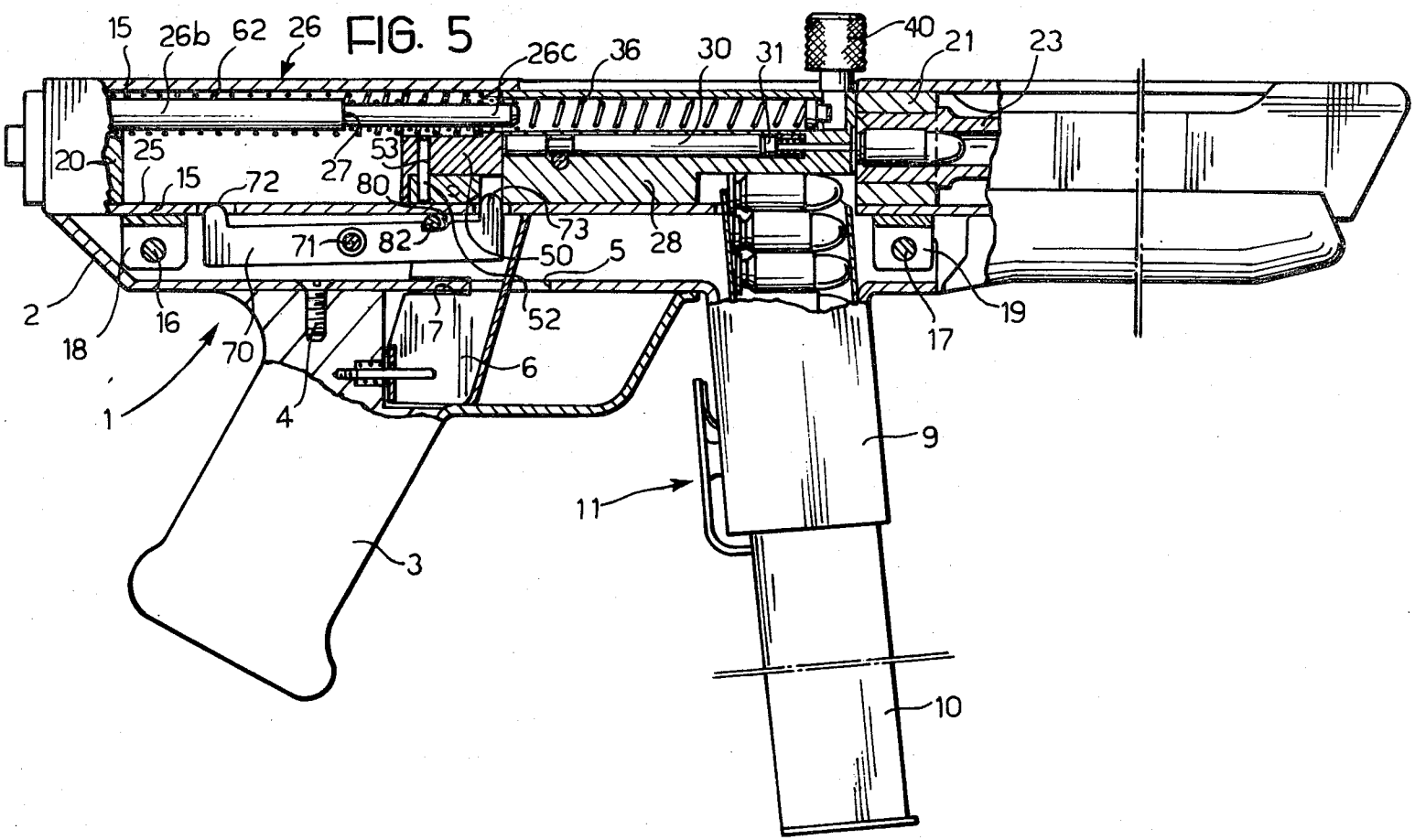

For firing, it suffices to pull the trigger 6. When the trigger is pulled, the pin 82 moves towards the rear of the fire-arm until it is in a position facing the notch 80 of the rocker lever 70. In this condition, the front end of the sear 52 overcomes the opposition of the retaining tooth 72 due to the action exerted by the return spring 62 on the hammer block 50, and the rocker lever 70 rotates in an anti-clockwise sense, this rotation being caused by the thrust of the inclined end surface 58 of the sear 52 bearing against the rear retaining tooth 72. The hammer block 50 is no longer retained and is released under the action of the return spring 62, being brought to bear against the bolt 28 and then against the rear end of the thrust member 30 of the striker mechanism. This thrust member urges the firing pin 31 to strike the percussion cap of the cartridge in the breech of the barrel (FIG. 5).

Once the bullet has left, the pressure of the gases produced by the propellant charge acts on the base of the cartridge case, which bears against the front end face of the bolt 28 to achieve temporary contact and cause the withdrawal of the bolt, together with the hammer block 50, towards their respective arming positions. During this withdrawal, the bolt 28 carries the spent cartridge case towards an ejector tooth which is of conventional type (not shown). The case knocks against this ejector tooth and is flipped towards an ejector aperture (not shown).

The bolt and the hammer block return to the arming position (FIG. 3).

While the trigger 6 is pulled, the pin 82 carried thereby faces the notch 80 in the rocker lever 70. In the withdrawal stage, the lower rear corner of the bolt 28, which is preferably bevelled, pushes the front tooth 73 of the rocker lever downwardly to cause the rear retaining tooth 72 of this lever to be raised and thus prearranged to retain the hammer block 50 in its withdrawn and arming position. The return springs 36, 62 are compressed simultaneously during this withdrawing movement. When the withdrawn position is reached, the bolt 28 returns to the closing position under the action of the return spring 36. Just before it reaches this position, the bolt 28 clears the aperture 76 through which the tooth 73 of the rocker lever 70 extends, so that the latter again rotates in an anti-clockwise sense due to the action of the inclined plane 58 of the sear 52 of the hammer block on the rear retaining tooth 72. Thus, the hammer block 50 is released to advance and strike the rear end of the thrust member 30 of the striker mechanism, causing the firing of a subsequent round.

Naturally, the operation is repeated continuously in the above described manner, as long as the trigger 6 remains in the firing position.

The automatic fire-arm according to the invention has the advantage of allowing the firing of bursts at a low rate of fire. This results from the delay which is introduced between the moment when the bolt reaches the closing position in each cycle, and the subsequent moment when the hammer block, once released, reaches the striking position.

This characteristic results in exceptional stability and accuracy of firing of the fire-arm which therefore does not have any tendency to climb.

A further advantage lies in the noticeable increase in the firing power achieved by the fact that firing occurs with the bolt closed.

It is also possible to make automatic fire-arms which are light and easy to handle, and which have considerable accuracy during a sustained burst of firing typical of automatic fire-arms. Moreover, the low rate of firing also ensures reduced ammunition wastage.

Naturally, while the principle of the invention remains the same, the embodiments and the details of construction may be varied widely from that described and illustrated purely by way of non-limiting example, without departing from the scope of the present invention.

I claim:

1. An automatic firearm including: a frame; a casing supported by said frame; a barrel fixed to said casing; a chamber defined in said casing adjacent the breech end of said barrel; a bolt movably mounted in said chamber, said bolt being moveable through the effect of the pressure of gasses produced during firing from a forward closing position in which it closes the breech end of said barrel to a withdrawn open position; first resilient means biasing said bolt into said closing position; a firing pin carried by said bolt; hammer block means mounted in said chamber and moveable between a withdrawn arming position and a forward striking position in which it acts on said firing pin; second resilient means biasing said hammer block means into said forward striking position; a trigger and a firing mechanism having a control member acutated by said trigger and operable to allow the movement of said hammer block means from said arming position to said striking position wherein the improvement comprises: a moveable one piece retaining member supported by said frame for movement into and out of said chamber, said retaining member being moveable to a hammer block means retaining position by engagement with said bolt upon movement of said bolt and said hammer block means from the respective forward positions to the respective withdrawn positions wherein said retaining member engages and retains said hammer block means in the withdrawn position and being moveable from said retaining position to a rest position in said chamber solely by engagement with said hammer block means upon forward movement of said hammer block means only when said bolt is in said closing position out of engagement with said retaining member and said control member which is controlled by said trigger and cooperates with said retaining member, said control member moveable between a first position in which it holds said retaining member in said retaining position when said said trigger is released and a second position in which said control member allows movement of said retaining member from said retaining position to said rest position and back when said trigger is pulled.

2. A firearm according to claim 1 wherein first and second apertures are provided in said casing wall defining said chamber, said first aperture being between the forward position and the withdrawn position of said bolt and said second aperture being between the forward position and the withdrawn position of said bolt and second aperture being between the forward position and the withdrawn position of said hammer block means; said moveable retaining member comprises a rocker lever rotatably mounted about an axis perpendicular to the path of movement of said hammer block means and said bolt, said lever having first and second projections at respective ends being rotatable about said axis between an angular rest position in which said first projection extends into said chamber through said first aperture and an angular hammer block means retaining position in which said second projection extends into said chamber through said second aperture; and said hammer block means includes locking means for engagement with said second projection of said lever when it is in said retaining position and said hammer block means is in said withdrawn position.

3. A firearm according to claim 2 wherein said locking means comprises a sear pivotally mounted on said hammer block means and adapted to be moved to a passive position by engagement with said second projection of said lever upon movement of said hammer block means to said withdrawn position and resilient means for biasing said sear into active position in which it engages said second projection of said lever to hold said hammer block means in said withdrawn position.

* * * * *